US010946638B2

(12) United States Patent
Jung

(10) Patent No.: US 10,946,638 B2
(45) Date of Patent: Mar. 16, 2021

(54) HYBRID TRANSFER MACHINE

(71) Applicant: KYUNGIL-TECH CO., LTD., SeoGyeongsangnam-do (KR)

(72) Inventor: Soon Tae Jung, Gyeongsangnam-do (KR)

(73) Assignee: KYUNGIL-TECH CO., LTD., Gyeongsangnam-do (KR)

( * ) Notice: Subject to any disclaimer, the term of this patent is extended or adjusted under 35 U.S.C. 154(b) by 325 days.

(21) Appl. No.: 15/704,353

(22) Filed: Sep. 14, 2017

(65) Prior Publication Data

US 2019/0047280 A1 Feb. 14, 2019

(30) Foreign Application Priority Data

Aug. 10, 2017 (KR) ..... 10-2017-0101626

(51) Int. Cl.

| | |
|---|---|
| ***B41F 16/00*** | (2006.01) |
| ***B41F 16/02*** | (2006.01) |
| *B41M 1/26* | (2006.01) |
| *B41M 5/025* | (2006.01) |
| *D06B 11/00* | (2006.01) |

(52) U.S. Cl.

CPC ..... *B41F 16/00* (2013.01); *B41F 16/006* (2013.01); *B41F 16/0026* (2013.01); *B41F 16/02* (2013.01); *B41M 1/26* (2013.01); *B41M 5/025* (2013.01); *D06B 11/0076* (2013.01)

(58) Field of Classification Search

None

See application file for complete search history.

(56) References Cited

U.S. PATENT DOCUMENTS

| | | | | | |
|---|---|---|---|---|---|
| 3,657,051 | A * | 4/1972 | McCarthy | B41F 1/08 | 156/384 |
| 3,689,350 | A * | 9/1972 | Renaut | B41F 16/02 | 156/540 |
| 4,052,935 | A * | 10/1977 | Ward | B41F 16/00 | 101/11 |
| 4,057,864 | A * | 11/1977 | Wild | B41F 16/02 | 8/467 |
| 4,115,234 | A * | 9/1978 | Anselrode | B41F 16/02 | 204/471 |

(Continued)

FOREIGN PATENT DOCUMENTS

| | | |
|---|---|---|
| KR | 2002071740000 | 12/2000 |
| KR | 2003176300000 | 6/2003 |

(Continued)

*Primary Examiner* — Jill E Culler

(74) *Attorney, Agent, or Firm* — IPLA P.A.

(57) ABSTRACT

A hybrid transfer machine includes: a body including a first drum installation part, a second drum installation part, a first body, a second body, and a worktable; a first drive means configured to allow wound fabric to be unwound; a thermal transfer unit configured to be installed in the second body, and to press and heat the fabric and transfer paper; a piece-type roller arm configured to be installed in the second body, and to guide the transfer paper to the third drum installation part; a second drive means configured to allow the transfer paper to be wound; a third drive means configured to allow the fabric to be wound; and a conveyer configured to be installed in the body, and to transfer the fabric and the transfer paper to the third and fourth drum installation parts.

4 Claims, 12 Drawing Sheets

(56) References Cited

U.S. PATENT DOCUMENTS

| | | | | | |
|---|---|---|---|---|---|
| 4,116,022 | A * | 9/1978 | Lopata | B41F 16/02 | 101/470 |
| 4,151,033 | A * | 4/1979 | Metzger | B32B 29/02 | 156/235 |
| 4,577,559 | A * | 3/1986 | Burger | B41F 13/00 | 101/221 |
| 5,943,952 | A * | 8/1999 | Monti | B41F 16/02 | 101/33 |
| 8,794,141 | B2 * | 8/2014 | Schaede | B41F 9/002 | 101/152 |
| 2011/0162544 | A1 * | 7/2011 | Ruhmke | B41F 13/0024 | 101/216 |
| 2017/0144431 | A1 * | 5/2017 | Jung | B41F 16/02 | |

FOREIGN PATENT DOCUMENTS

| | | |
|---|---|---|
| KR | 1020140059619 | 5/2017 |
| KR | 1020171159620 | 5/2017 |

* cited by examiner

HYBRID TRANSFER MACHINE

CROSS REFERENCE

This application claims foreign priority under Paris Convention to Korean Patent Application No. 10-2017-0101626, filed 10 Aug. 2017, with the Korean Intellectual Property Office, the entirety of which is incorporated herewith.

BACKGROUND

The present invention relates to a hybrid transfer machine having improved operability, which can be used for both a roll-type purpose and a piece-type purpose and also enables an initial setting operation to be rapidly and conveniently performed.

Generally, designs are printed on fabrics, such as handkerchiefs, clothes, etc., chiefly using a transfer printing method.

A transfer printing method is designed to transfer the design of transfer paper onto fabric by placing the transfer paper having a specific design, a photo, or the like on the print target fabric and then moving a heating roller, the transfer paper, and the fabric in one direction in the state of pressing both the transfer paper and the fabric with the heating roller heated to an appropriate temperature so that the transfer paper and the fabric come into tight contact with each other.

Generally, a transfer printing machine is configured such that: a feed roller, a tension roller, a discharge roller, and a plurality of idle rollers are installed in front of, below, above, and in back of a heating roller, respectively; a belt is installed such that the outside surface thereof surrounds the circumference of the heating roller and the inner circumferential surface thereof is slidably movable over the outer circumferential surfaces of the feed roller, the tension roller, the discharge roller, and the plurality of idle rollers; and transfer paper and fabric are fed between the heating roller and the belt in a stacked manner, thereby performing transfer printing.

Such transfer printing machines are classified into roll-type machines and piece-type machines. Roll-type machines are designed to automatically and continuously feed fabric and transfer paper, and piece-type machines are designed to automatically feed transfer paper and to feed fabric on a per-piece basis.

Meanwhile, conventionally, it is necessary to separately purchase a roll-type transfer machine and a piece-type transfer machine, and thus the operating cost increases. Furthermore, the two machines are disposed within the same space, and thus the efficiency of space utilization is considerably reduced.

Meanwhile, in the case of conventional transfer machines, transfer paper must be connected with tissue and fabric via a narrow gap from the outside, and thus an initial setting operation is not only significantly inconvenient, but also setting time is excessively long, thereby causing a fundamental problem in that operability is considerably degraded.

SUMMARY OF THE INVENTION

The present invention has been conceived to overcome the above-described problems, and an object of the present invention is to provide a hybrid transfer machine having improved operability, which can be used for both a roll-type purpose and a piece-type purpose and also enables an initial setting operation to be rapidly and conveniently performed.

In order to accomplish the above object, the present invention provides a hybrid transfer machine, including: a body including a first drum installation part configured such that a transfer paper feed drum is rotatably installed therein, a second drum installation part configured such that a fabric feed drum is rotatably installed therein, a first body configured such that an entrance is formed therethrough so that an operator enters thereinto and performs an operation, a second body configured to be disposed adjacent to the first body and configured such that a third drum installation part and a fourth drum installation part are sequentially formed from the lower portion of one side of the outside thereof, and a worktable configured to be installed on the top surface of the first body and to couple the first body with the second body;

a first drive means configured to allow wound fabric to be unwound by rotating the fabric feed drum;

a thermal transfer unit configured to be installed in the second body, and to press and heat the fabric and transfer paper fed from the worktable so that the print object of the transfer paper is transferred onto the fabric;

a piece-type roller arm configured to be installed in the second body, and to guide the transfer paper, fed from the thermal transfer unit, to the third drum installation part;

a second drive means configured to allow the transfer paper to be wound by rotating a transfer paper take-up drum which is rotatably installed in the third drum installation part;

a third drive means configured to allow the fabric, onto which the print object has been transferred, to be wound by rotating a fabric take-up drum which is rotatably installed in the fourth drum installation part; and a conveyer configured to be installed in the body, and to transfer the fabric and the transfer paper, passed through the thermal transfer unit, to the third and fourth drum installation parts.

The hybrid transfer machine may further include:

a fifth drum installation part configured such that a tissue take-up drum is rotatably installed therein;

a sixth drum installation part configured such that a tissue feed drum is rotatably installed therein; and a fourth drive means configured to allow the tissue to be wound by rotating a tissue take-up drum which is rotatably installed in the fifth drum installation part.

In this case, the fifth drum installation part and the sixth drum installation part may be sequentially installed in the upper portion of the fourth drum installation part of the second body.

The hybrid transfer machine may further include a first roller configured to be disposed between the thermal transfer unit and the conveyer, to be rotatably installed in the first body, and to guide the transfer paper, exiting from the thermal transfer unit, to the transfer paper take-up drum.

The hybrid transfer machine may further include:

a crank configured to be rotatably installed in the second body, and to guide the transfer paper, exiting from the thermal transfer unit, to the first roller; and a transfer paper guide unit configured to be installed in the second body, and to include an actuator which rotates the crank around a shaft.

The hybrid transfer machine may further include a third roller configured to be rotatably installed adjacent to the worktable in the first body, and to guide the transfer paper, exiting from the thermal transfer unit, to the first roller.

The hybrid transfer machine may further include:

a third roller configured to be rotatably installed adjacent to the worktable inside the first body, and to guide the transfer paper exiting from the thermal transfer unit;

a fourth roller configured to be rotatably installed between the third roller and the conveyer inside the first body, and to guide the transfer paper, guided by the third roller, to the transfer paper take-up drum; and a fifth roller configured to be rotatably installed between the third roller and the fourth roller inside the first body, and to guide the tissue, exiting from the thermal transfer unit, to the tissue take-up drum.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

The present invention will be described in detail below with reference to the accompanying drawings.

A hybrid transfer machine according to the present invention is capable of performing both roll-type transfer and piece-type transfer. For ease of description, roll-type embodiments will be described first, and then piece-type embodiments will be described.

First Embodiment

Figure 1A:
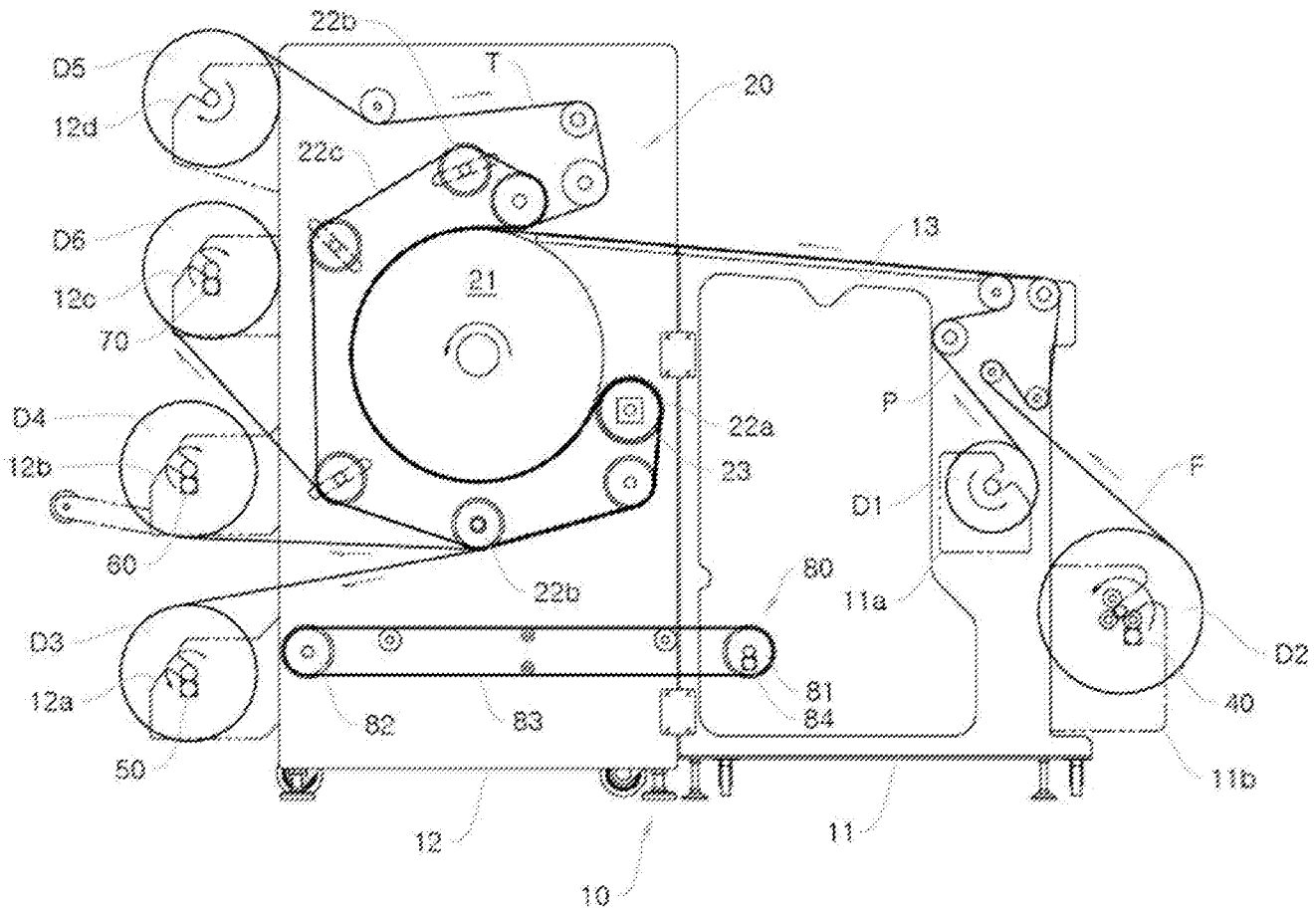
FIG. 1A is a front view showing a hybrid transfer machine according to a first roll-type embodiment of the present invention.
Figure 1B:
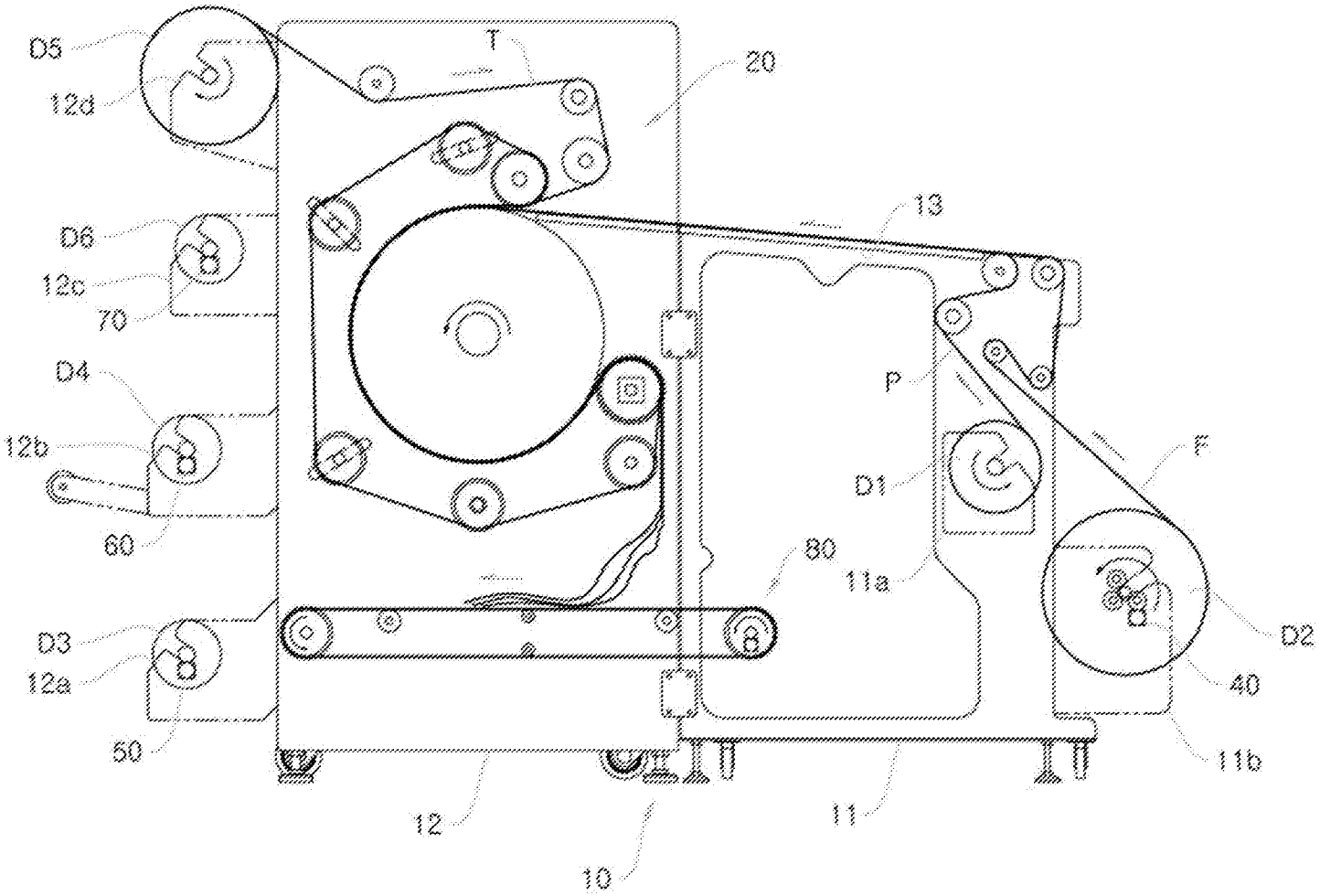
FIG. 1B is a view illustrating a preparation process of FIG. 1A.

FIG. 1A is a front view showing a hybrid transfer machine according to a first roll-type embodiment of the present invention, and FIG. 1B is a view illustrating a preparation process of FIG. 1A.

Referring to FIGS. 1A and 1B, the hybrid transfer machine according to the first roll-type embodiment includes a body 10, a thermal transfer unit 20, a first drive means 40, a second drive means 50, a third drive means 60, a fourth drive means 70, and a conveyer 80.

The body 10 includes a first body 11, a second body 12, and a worktable 13, and forms the overall appearance of the hybrid transfer machine according to the present invention.

The first body 11 is provided with a first drum installation part 11*a* configured such that a transfer paper feed drum D1 is rotatably installed therein and a second drum installation part 11*b* configured such that a fabric feed drum D2 is rotatably installed therein.

In this case, the transfer paper feed drum D1 provides transfer paper P before use.

The fabric feed drum D2 rotatably installed in the second drum installation part 11*b* is rotated by the first drive means 40, and provides fabric F before transfer.

In this case, notable is the fact that an entrance 11*c* is formed through the first body 11 so that an operator can enter into the hybrid transfer machine and perform a task, which will be described in detail later.

The second body 12 is disposed adjacent to the first body 11, and is connected to the first body 11 so that the insides thereof communicate with each other. A third drum installation part 12*a*, a fourth drum installation part 12*b*, a fifth drum installation part 12*c*, and a sixth drum installation part 12*d* are sequentially installed from the lower portion of one side (the left side based on FIGS. 1A and 1B) of the outside of the second body 12.

A transfer paper take-up drum D3 is rotatably installed in the third drum installation part 12*a*, and is rotated by the second drive means 50 so that transfer paper P after transfer is wound therearound.

A fabric take-up drum D4 is rotatably installed in the fourth drum installation part 12*b*, and is rotated by the third drive means 60 so that fabric F after transfer is wound therearound.

A tissue take-up drum D6 is rotatably installed in the fifth drum installation part 12*c*, and is rotated by the fourth drive means 70 so that tissue T after use is wound therearound.

A tissue feed drum D5 is rotatably installed in the sixth drum installation part 12*d*, and provides tissue T before use.

For reference, when the second body 12 is brought into contact with and connected to the first body 11, there is formed a structure in which the insides thereof communicate with each other.

The thermal transfer unit 20 includes a heating drum 21, a contact mechanism 22, and a first drive pulley driving means 23, and is installed inside the second body 12. In the case of the present embodiment, the thermal transfer unit 20 functions to press and apply heat to the transfer paper P, the fabric F and the tissue T (which may be omitted as desired) having entered between the heating drum 21 and the contact mechanism 22 so that the print object of the transfer paper P can be transferred onto the fabric F, and to then discharge the transfer paper P, the fabric F, and the tissue T. For reference, the transfer paper P, the fabric F, and the tissue T (which may be omitted as desired) are discharged through an end pulley in the direction in which the transfer paper P heated by the heating drum 21 of the thermal transfer unit 20 is discharged, in which case the end pulley is the first drive pulley 22*a* of the contact mechanism 22.

The heating drum 21 is provided with a heater (not shown) therein. In the case of the present embodiment, the heating drum 21 is rotatably installed inside the second body 12.

The contact mechanism 22 is disposed adjacent around the heating drum 21. The contact mechanism 22 includes: a first drive pulley 22*a* configured to receive power from the first drive pulley driving means 23 and to rotate; a first driven pulley 22*b*; and a first belt 22*c* configured to surround the first drive pulley 22*a* and the first driven pulley 22*b*, to transfer power from the first drive pulley 22*a* to the first driven pulley 22*b*, to come into tight contact with the circumferential surface of the heating drum 21, and to rotate the heating drum 21.

The first drive pulley driving means 23 is a (servo) motor. The first drive pulley driving means 23 is coupled to the first drive pulley 22*a* via a coupling means (for example, a belt, a chain, or the like), and functions to drive the first drive pulley 22*a*.

According to the present embodiment, the first drive pulley 22*a* receives power from the first drive pulley driving means 23 and operates, and the first belt 22*c* passed over the first drive pulley 22*a* is rotated by the rotation of the first drive pulley 22*a*, with the result that the first driven pulley 22*b* coupled to the first drive pulley 22*a* via the first belt 22*c* is rotated.

Furthermore, as the first belt 22*c* is rotated, the heating drum 21 in contact with the first belt 22*c* is also rotated.

For reference, it is preferred that part of the first driven pulley 22*b* is configured to be movable in order to adjust the interval between the first belt 22*c* and the heating drum 21.

Meanwhile, as in the conventional technology, a variation may be made in a form in which the belt 22*c* is rotated using frictional force by coupling the first drive pulley driving means 23 to the heating drum 21 via a coupling means (for example, a belt, a chain, or the like), rather coupling the first drive pulley driving means 23 to the drive pulley 22*a*, and then rotating the heating drum 21.

Additionally, various types of well-known technology may be used as the thermal transfer unit 20 as desired.

The conveyer 80 is disposed in the lower portion of the body 10, more specifically below the thermal transfer unit 20 inside the second body 12, and functions to transfer the front end portions of the transfer paper P, the fabric F, and the tissue T (which may be omitted as desired), exiting via the thermal transfer unit 20, to an adjacent location so that an operator can install them over the third, fourth and fifth drum installation parts 12*a*, 12*b* and 12*c*.

The conveyer 80 includes a second drive pulley 81 configured to receive power from the second drive pulley driving means 84 and to operate, a second driven pulley 82, and a second belt 83 configured to surround the second drive pulley 81 and the second driven pulley 82 and to transfer power from the second drive pulley 81 to the second driven pulley 82.

The operation of setting the transfer paper P, the fabric F, and the tissue T (which may be omitted as desired) according the first embodiment (of a roll type) will be described below.

As shown in FIG. 1B, an operator having entered into the hybrid transfer machine via the entrance 11*c* of the first body 11 disposes the transfer paper P, the fabric F, and the tissue T (which may be omitted as desired) while holding the front end portions of the transfer paper P, the fabric F, and the tissue T (which may be omitted as desired) in the state in which the transfer paper P, the fabric F, and the tissue T (which may be omitted as desired) are exiting via the thermal transfer unit 20 so that they can be loaded on the conveyer 80.

When the conveyer 80 is operated in the arranged state, the transfer paper P, the fabric F, and the tissue T (which may be omitted as desired) placed on the second belt 83 is transferred to one side of the second body 12 (the left side based on FIGS. 1A and 1B). Then the operator exits to the outside via the entrance 11*c*, and winds the transfer paper P, the fabric F, and the tissue T (which may be omitted as desired) around the transfer paper take-up drum D3 of the third drum installation part 12*a*, the fabric take-up drum D4 of the fourth drum installation part 12*b*, and the tissue take-up drum D6 of the fifth drum installation part 12*c*, respectively.

Next, the operation of the first embodiment (of a roll type) will be described.

When an operation button is pressed in the set state, the heating drum 21 and the contact mechanism 22 are rotated by the first drive pulley driving means 23 in the state of being in contact with each other.

Furthermore, as the transfer paper take-up drum D3 is driven by the second drive means 50, the transfer paper take-up drum D3 gradually winds the transfer paper P, with the result that the transfer paper feed drum D1 is rotated and unwinds the transfer paper P.

Furthermore, as the fabric feed drum D2 is driven by the first drive means 40, the fabric F wound around the fabric feed drum D2 is unwound.

Furthermore, as the fabric take-up drum D4 is driven by the third drive means 60, the fabric take-up drum D4 gradually winds the fabric F, with the result that the unwound fabric F is transferred to the worktable 13 via rollers (see FIGS. 1A and 1B).

Furthermore, as the tissue take-up drum D6 is driven by the fourth drive means 70, the tissue take-up drum D6 gradually winds the tissue T, with the result that the tissue feed drum D5 is rotated and unwinds the tissue P and the unwound tissue T is transferred to the thermal transfer unit 20 via the rollers (see FIGS. 1A and 1B).

The tissue T is placed on the transfer paper P and the fabric F moved along the worktable 13 during a process in which the transfer paper P and the fabric F enter into the thermal transfer unit 20, and is transferred along with the transfer paper P and the fabric F. As the entered transfer paper P, the fabric F and the tissue T are pressed (compressed) and heated by the heating drum 21 and the contact mechanism 22, the print object of the transfer paper P is transferred onto the fabric F. The transfer paper P, the fabric F, and the tissue T discharged in the state of being superimposed on top of one another via the thermal transfer unit 20 are separated at a specific location (see FIGS. 1A and 1B), and then the transfer paper P is wound around the transfer paper take-up drum D3, the fabric F is wound around the fabric take-up drum D4, and the tissue T is wound around the tissue take-up drum D6.

Meanwhile, the above-described tissue feed drum D5, tissue take-up drum D6, and fourth drive means 70 may be excluded from the first embodiment as desired.

According to the present embodiment, an operator can enter via the entrance 11*c* formed through the body 10 and place the transfer paper P, the fabric F, and the tissue T (which may be omitted as desired) on the conveyer 80 installed inside the body 10 during an initial setting operation, and the transfer paper P, the fabric F, and the tissue T (which may be omitted as desired) can be conveniently transferred via the conveyer 80. Accordingly, an advantage arises in that the operation of connecting and installing the transfer paper P, the fabric F, and the tissue T (which may be omitted as desired) to and on the respective take-up drums is further facilitated.

Second Embodiment

Figure 2A:
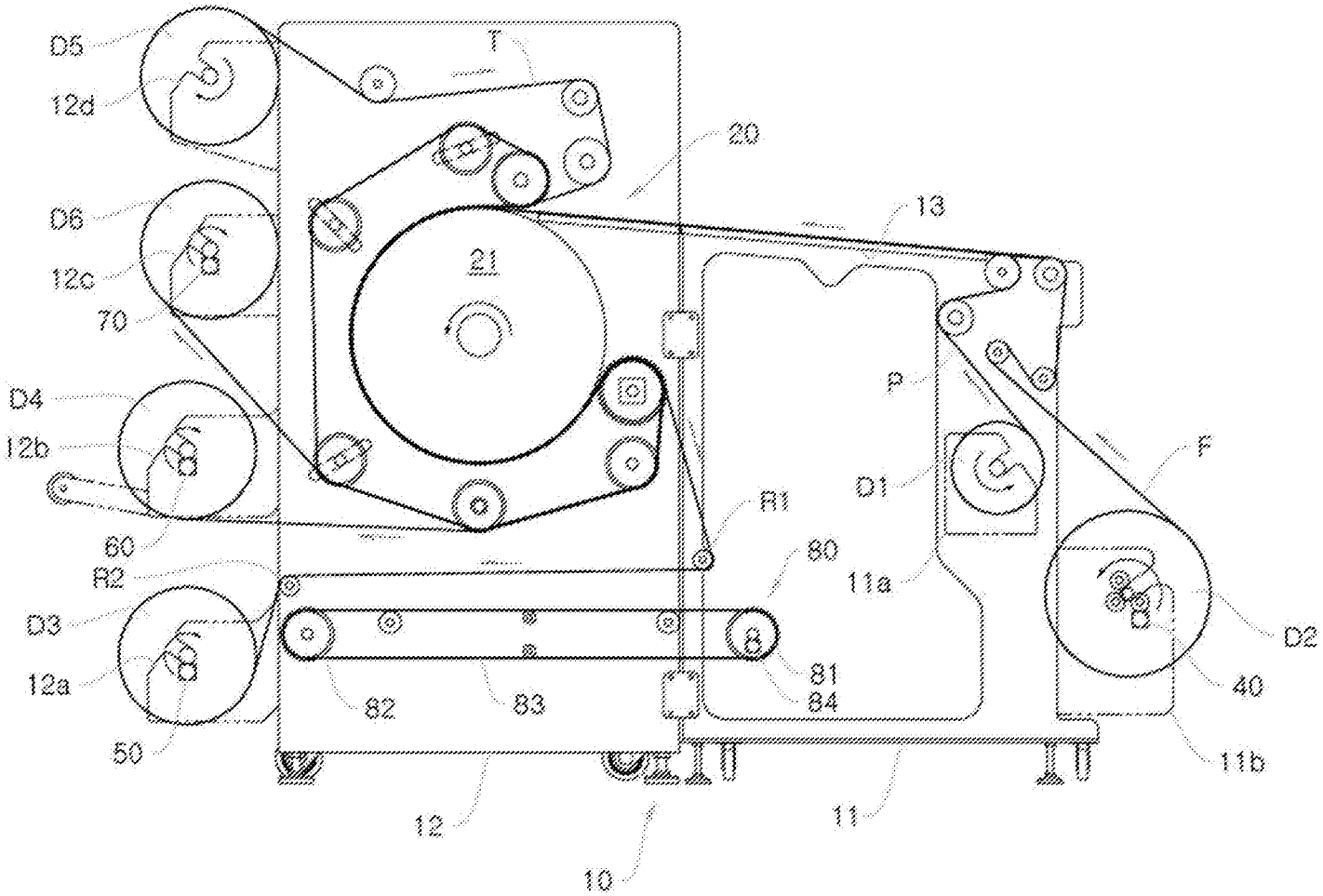
FIG. 2A is a front view showing a hybrid transfer machine according to a second roll-type embodiment of the present invention.
Figure 2B:
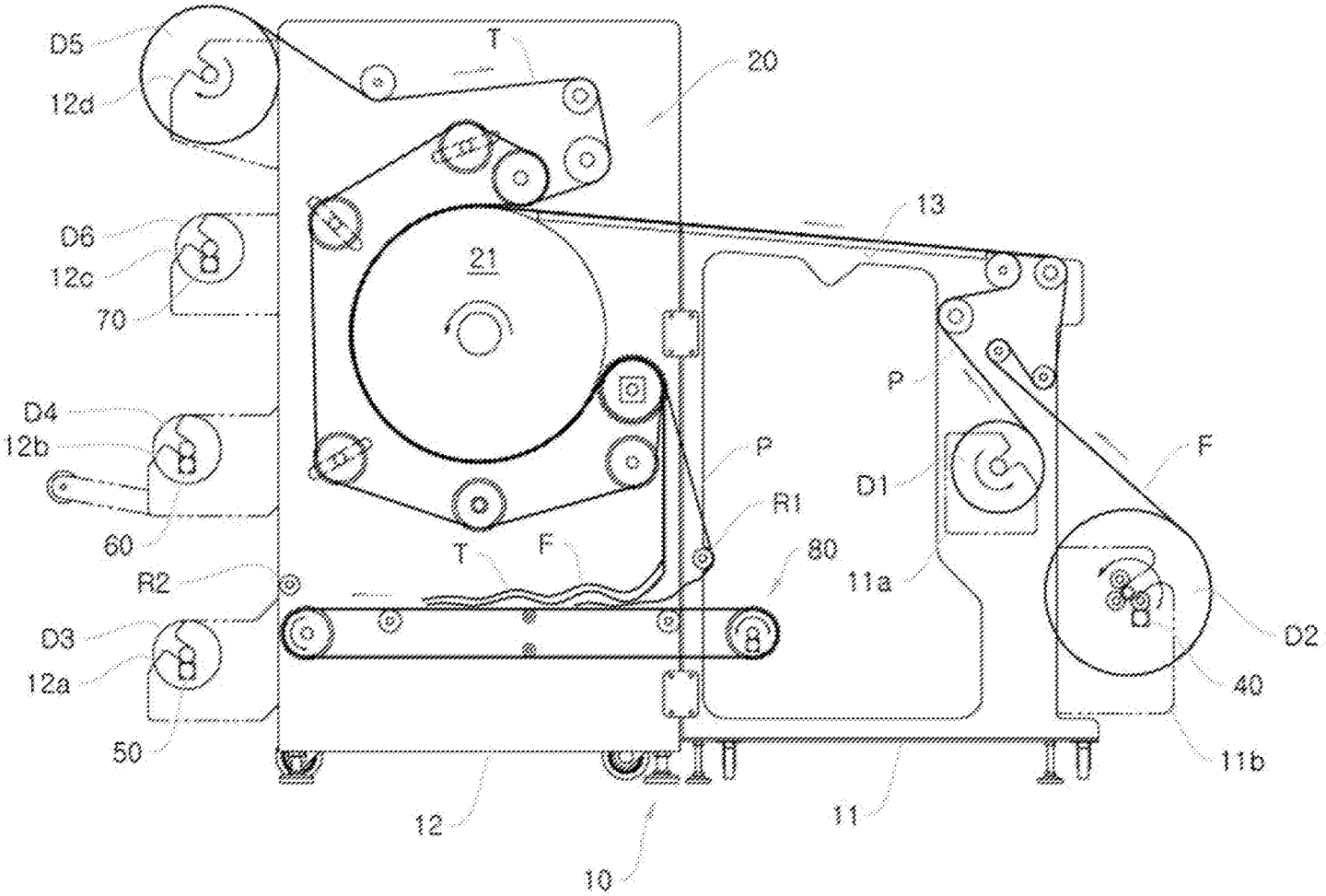
FIG. 2B is a view illustrating a preparation process of FIG. 2A.

FIG. 2A is a front view showing a hybrid transfer machine according to a second roll-type embodiment of the present invention, and FIG. 2B is a view illustrating a preparation process of FIG. 2A.

The overall configuration of the second embodiment is the same as that of the first embodiment only except that a first roller R1 and a second roller R2 (which may be omitted as desired) are further included in the second embodiment.

Referring to FIGS. 2A and 2B, the first roller R1 is disposed between a thermal transfer unit 20 and a conveyer 80. In the case of the present embodiment, the first roller R1 is rotatably installed in the first body 11, and functions to guide transfer paper P, exiting from the thermal transfer unit 20, to a transfer paper take-up drum D3.

The second roller R2 is disposed between the thermal transfer unit 20 and the conveyer 80 and below the first roller R1, and functions to receive the transfer paper P from the first roller R1 and to guide the transfer paper P to the paper take-up drum D3.

For reference, the second roller R2 may not be applied as desired.

As an example, the transfer paper P, the fabric F, and the tissue T (which may be omitted as desired) are discharged from the thermal transfer unit 20 in a superimposed state.

Meanwhile, when they are moved in the superimposed state for a long period of time, the transfer paper P and the fabric F are shaken due to vibrations during movement according to the type of transfer paper P, and thus there may occur a defect in which a transferred portion is smudged or migrated. Furthermore, there may occur a problem in which the transfer paper P and fabric F superimposed on each other are adhered to each other and not easily separated from each other.

Accordingly, as shown in FIG. 2B, when only the transfer paper P is loaded to be passed over the first roller R1, the transfer paper P and the fabric F are naturally separated from each other when the transfer paper P, the fabric F, and the tissue T (which may be omitted as desired) are discharged from the thermal transfer unit 20, thereby overcoming the problem in which a defect occurs in a product.

Third Embodiment

Figure 3A:
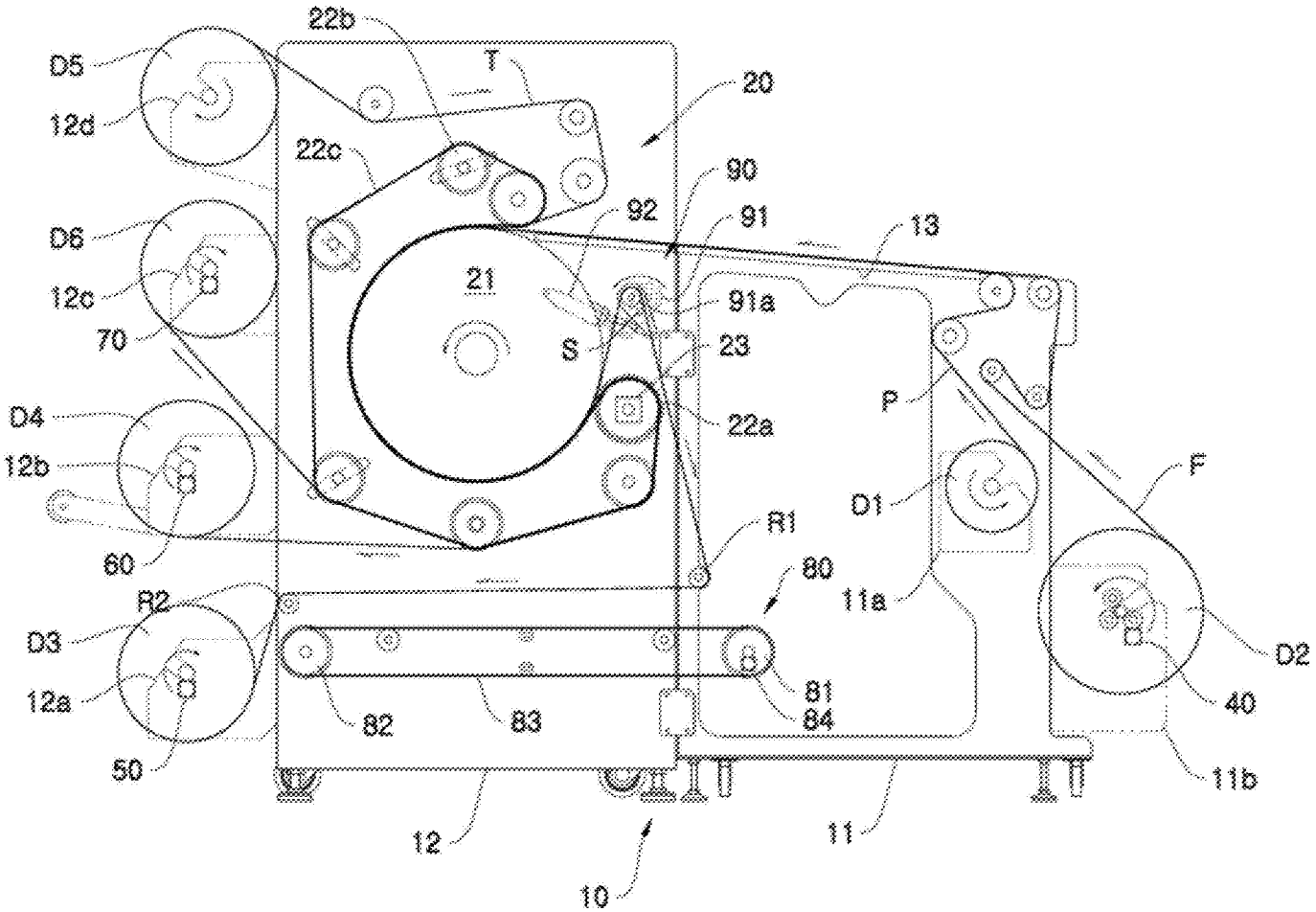
FIG. 3A is a front view showing a hybrid transfer machine according to a third roll-type embodiment of the present invention.
Figure 3B:
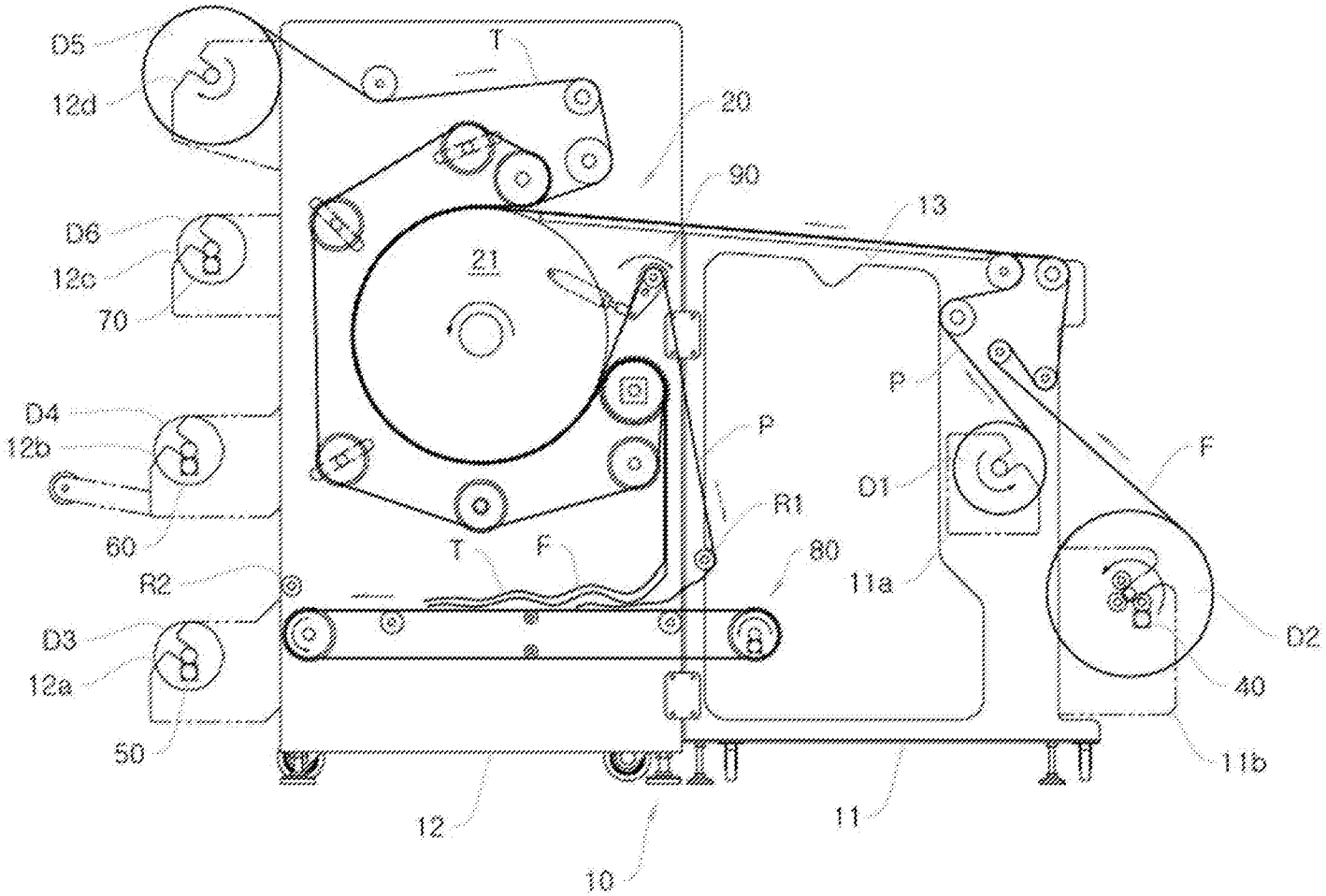
FIG. 3B is a view illustrating a preparation process of FIG. 3A.

FIG. 3A is a front view showing a hybrid transfer machine according to a third roll-type embodiment of the present invention, and FIG. 3B is a view illustrating a preparation process of FIG. 3A.

The overall configuration of the third embodiment is the same as that of the second embodiment only except that a transfer paper guide unit 90 is further included in the third embodiment.

Referring to FIGS. 3A and 3B, the transfer paper guide unit 90 is rotatably installed inside a second body 12. The transfer paper guide unit 90 includes a crank 91 configured to guide transfer paper P, exiting from a thermal transfer unit 20, to the first roller R1, and an actuator 92 configured to be installed inside a second body 12 and to rotate the crank 91 around a shaft S.

The crank 91 is rotatably fastened around the shaft S formed at the center thereof inside the second body 12, and a roller 91*a* configured to guide the transfer paper P is rotatably installed on the upper portion of the crank 19 above the shaft S.

Furthermore, the rod of the actuator 92 is coupled to the lower portion of the crank 91 below the shaft S in a linkage manner. The crank 91 is rotated around the shaft S by the forward or backward movement of the rod, and thus the roller 91*a* becomes disposed adjacent to or spaced apart from the thermal transfer unit 20. In the state in which the roller 91*a* has been spaced apart from the thermal transfer unit 20 as described above, an operator can load the transfer paper P on the first roller R1 via the roller 91*a* of the crank 91.

As an example, when the transfer paper P is installed to be passed over the roller 91*a* of the crank 91 as described above, the transfer paper P, the fabric F, and the tissue T (which may be omitted as desired) are discharged from the thermal transfer unit 20 in a superimposed state, and then the transfer paper P and the fabric F are naturally separated from each other, thereby overcoming the problem in which a defect occurs in a product.

Meanwhile, when the crank 91 is rotated by the actuator 92 and the roller 91*a* is spaced apart from the heating drum 21 of the thermal transfer unit 20, the interval between the heating drum 21 and the roller 91*a* of the crank 91 is increased, and thus an operator can easily load the transfer paper P on the roller 91*a*, with the result that advantages arise in that a setting operation is facilitated and the operator can be protected from a risk of burns.

In contrast, when the crank 91 is rotated by the actuator 92 and the roller 91*a* is disposed adjacent to the heating drum 21 of the thermal transfer unit 20, the transfer paper P, the fabric F, and the tissue T (which may be omitted as desired) are discharged from the thermal transfer unit 20 in a superimposed state, and then simultaneously the transfer paper P and the fabric F are naturally and rapidly separated from each other, thereby overcoming the problem in which a defect occurs in a product.

Next, a piece-type hybrid transfer machine according to the present invention will be described in detail.

First Embodiment

Figure 4A:
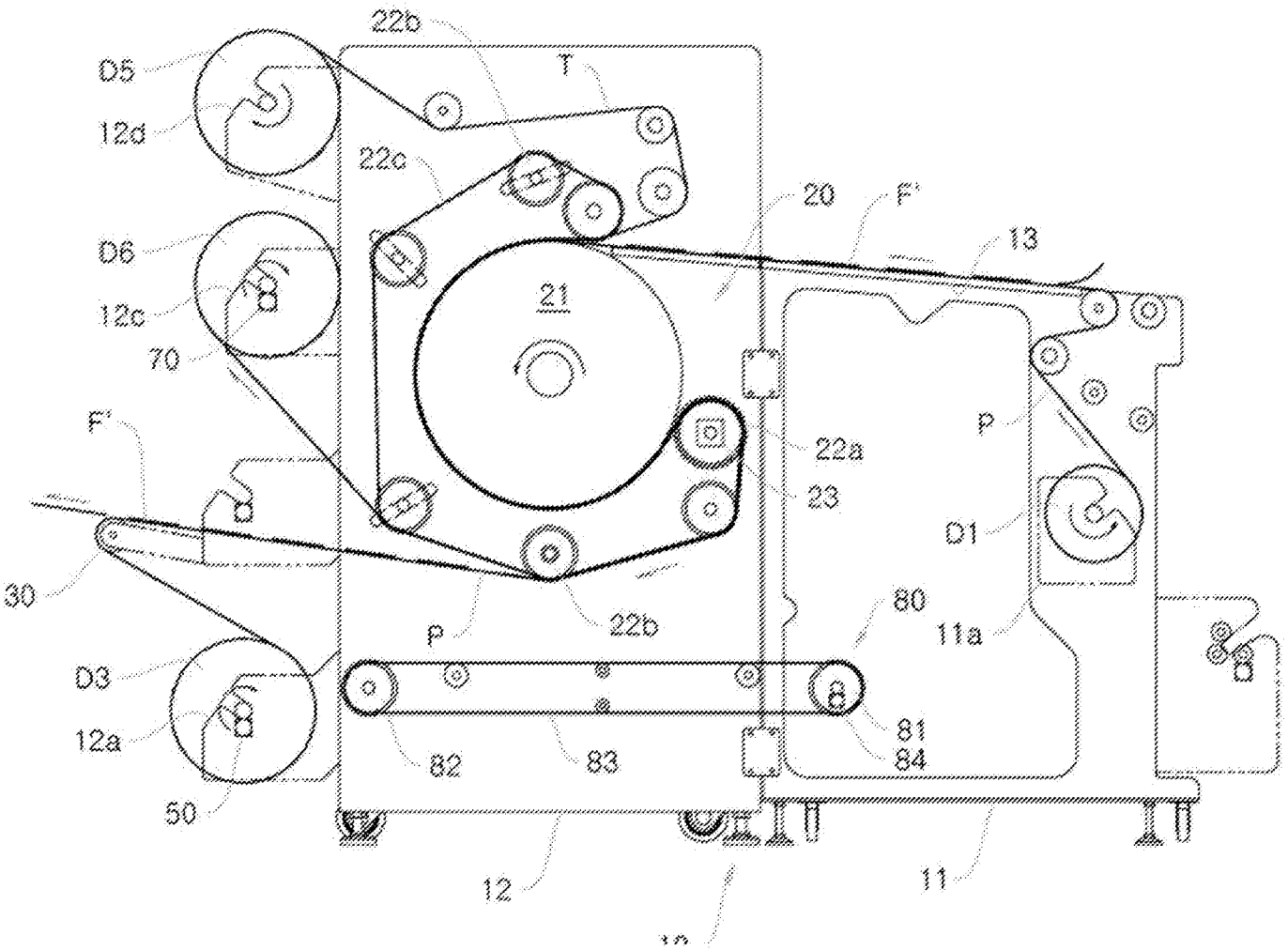
FIG. 4A is a front view showing a hybrid transfer machine according to a first piece-type embodiment of the present invention.
Figure 4B:
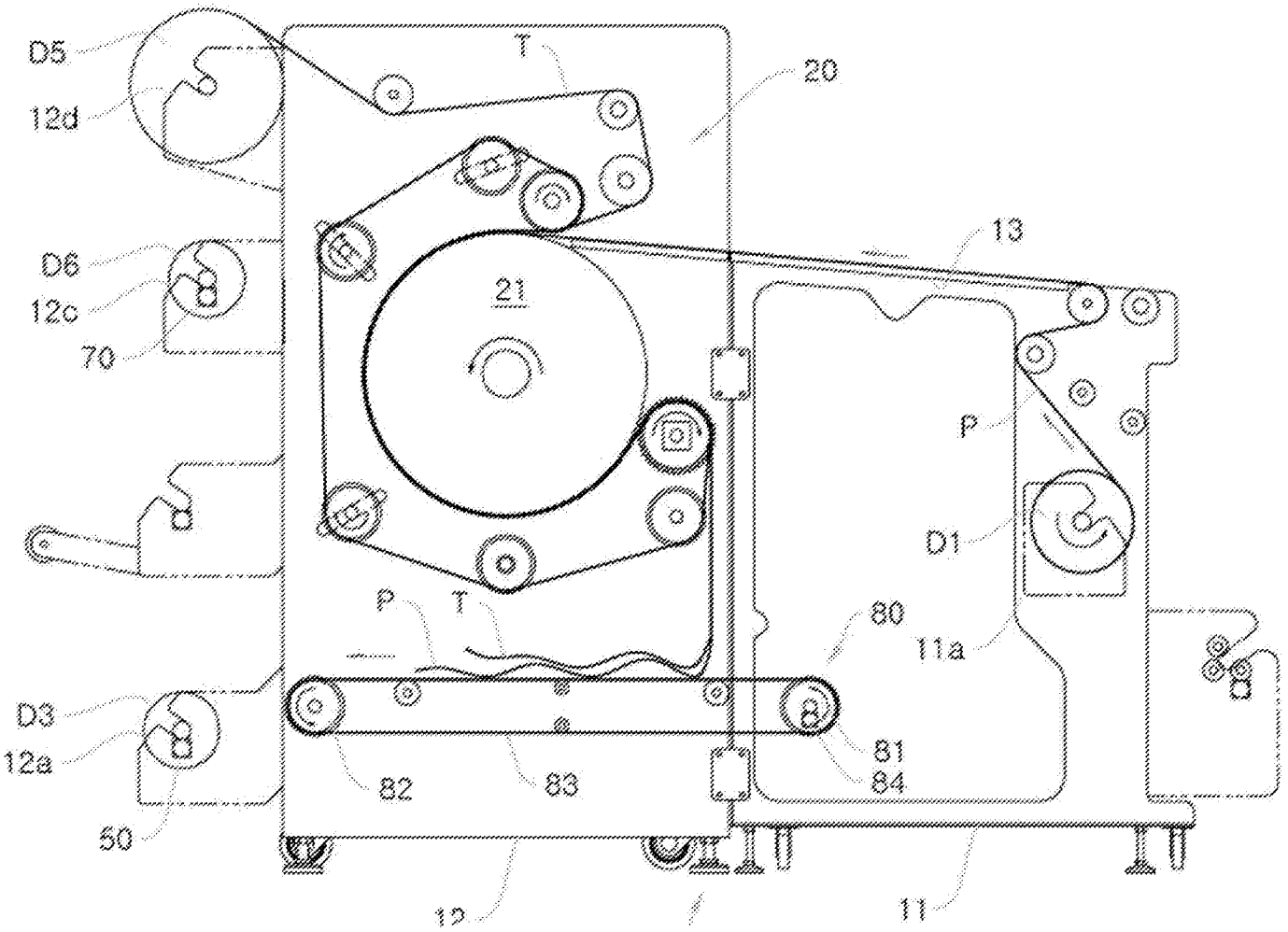
FIG. 4B is a view illustrating a preparation process of FIG. 4A.

FIG. 4A is a front view showing a hybrid transfer machine according to a first piece-type embodiment of the present invention, and FIG. 4B is a view illustrating a preparation process of FIG. 4A.

The configuration of the first piece-type embodiment is the same as the first roll-type embodiment only except that a piece-type roller arm 30 is applied to the first embodiment of a piece type.

The piece-type roller arm 30 is installed in the fourth drum installation part 12*b* of a second body 12 in the form of a cantilever, and functions to guide transfer paper P, fed from a thermal transfer unit 20, to a transfer paper take-up drum D3 rotatably installed in a third drum installation part 12*a*.

As an example, transfer paper P, each piece of fabric F', and tissue T (which may be omitted as desired) are discharged from the thermal transfer unit 20 in a superimposed state, and are separated from each other at a specific location (see FIGS. 4A and 4B). The transfer paper P is wound around a transfer paper take-up drum D3 via the piece-type roller arm 30, and the tissue T (which may be omitted as desired) is wound around a tissue take-up drum D6.

In this case, the piece of fabric F' is transferred in the state of being placed on the transfer paper P. The transferred piece of fabric F' may be naturally separated at and fall downward from an end of the piece-type roller arm 30, or an operator may separate the piece of fabric F' from the transfer paper P through a manual operation.

In other words, the transfer paper P functions as a media used to transfer a print object onto the piece of fabric F', and also functions as a transfer means (a conveyer) used to transfer the piece of fabric F'.

The operation of setting the transfer paper P, the fabric F, and the tissue T (which may be omitted as desired) according to the first embodiment of a piece type will be described below.

As shown in FIG. 4B, an operator having entered into the hybrid transfer machine via the entrance 11*c* of a first body 11 disposes the transfer paper P and the tissue T (which may be omitted as desired) while holding the front end portions of the transfer paper P and the tissue T (which may be omitted as desired) in the state in which the transfer paper P and the tissue T (which may be omitted as desired) are exiting via the thermal transfer unit 20 so that they can be loaded on a conveyer 80.

When the conveyer 80 is operated in the arranged state, the transfer paper P and the tissue T (which may be omitted as desired) placed on a second belt 83 are transferred to one side of the second body 12 (the left side based on FIGS. 4A and 4B). Then the operator exits via the entrance 11*c*, winds the transfer paper P around the transfer paper take-up drum D3 of a third drum installation part 12*a* via the piece-type roller arm 30, and winds the tissue T (which may be omitted as desired) around the tissue take-up drum D6 of a fifth drum installation part 12*c*, thereby completing the setting operation.

Next, the operation of the first embodiment of a piece type will be described.

When an operation button is pressed in the set state, a heating drum 21 and a contact mechanism 22 are rotated by a first drive pulley driving means 23 in the state of being in contact with each other. As a transfer paper take-up drum D3 is driven by a second drive means 50, the transfer paper take-up drum D3 gradually winds the transfer paper P, with the result that the transfer paper feed drum D1 is rotated and unwinds the transfer paper P.

Furthermore, as a tissue take-up drum D6 is driven by a fourth drive means 70, the tissue take-up drum D6 gradually winds the tissue T (which may be omitted as desired), with the result that a tissue feed drum D5 is rotated and unwinds the tissue P and the unwound tissue T is transferred to the thermal transfer unit 20 via rollers (see FIGS. 4A and 4B).

Furthermore, a piece of fabric F' is placed on the transfer paper P being moved along the worktable 13, and is transferred along with the transfer paper P. The transfer paper P, the piece of fabric F', and tissue T (which may be omitted as desired) enter into the thermal transfer unit 20 in a superimposed state.

As the transfer paper P, the piece of fabric F' and the tissue T (which may be omitted as desired) having entered into the thermal transfer unit 20 are pressed (compressed) and heated by the heating drum 21 and the contact mechanism 22, the print object of the transfer paper P is transferred onto the piece of fabric F', and the transfer paper P, the piece of fabric F' and the tissue T (which may be omitted as desired) are discharged via the thermal transfer unit 20 in a superimposed state. The transfer paper P, the piece of fabric F' and the tissue T are separated at a specific location (see FIGS. 1A and 1B). Then the transfer paper P is wound around the transfer paper take-up drum D3 of the third drum installation part 12*a* via the piece-type roller arm 30, and the tissue T (which may be omitted as desired) is wound around the tissue take-up drum D6 of the fifth drum installation part 12*c*.

In this case, the piece of fabric F' is transferred in the state of being placed on the transfer paper P. The transferred piece of fabric F' may be naturally separated at and fall downward from an end of the piece-type roller arm 30, or an operator may separate the piece of fabric F' from the transfer paper P through a manual operation.

In other words, the transfer paper P functions as a media used to transfer a print object onto the piece of fabric F' and also functions as a transfer means (a conveyer) used to transfer the piece of fabric F'.

Meanwhile, the above-described tissue feed drum D5, tissue take-up drum D6 and fourth drive means 70 may be excluded from the first embodiment as desired.

Second Embodiment

Figure 5A:
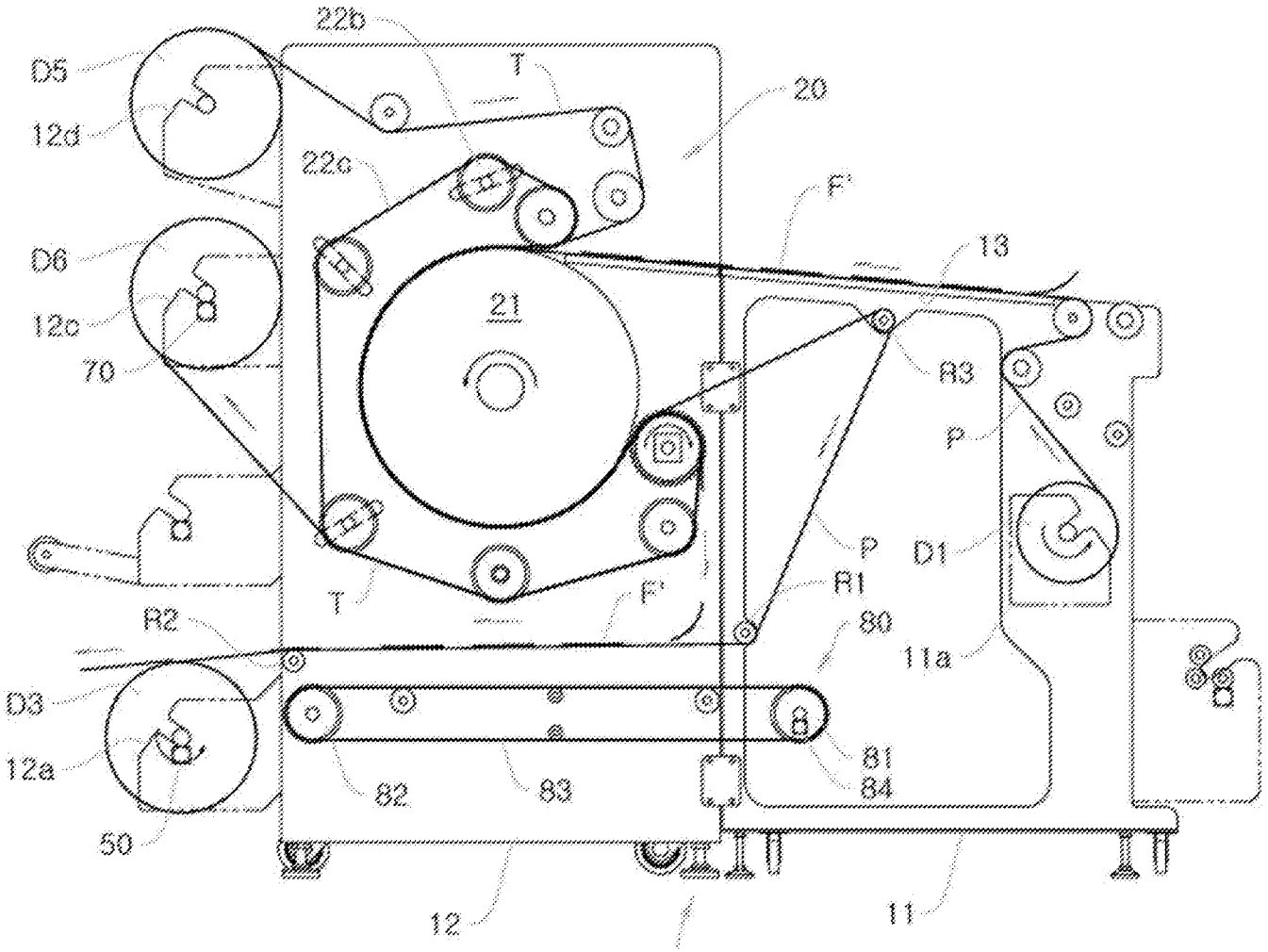
FIG. 5A is a front view showing a hybrid transfer machine according to a second piece-type embodiment the present invention.
Figure 5B:
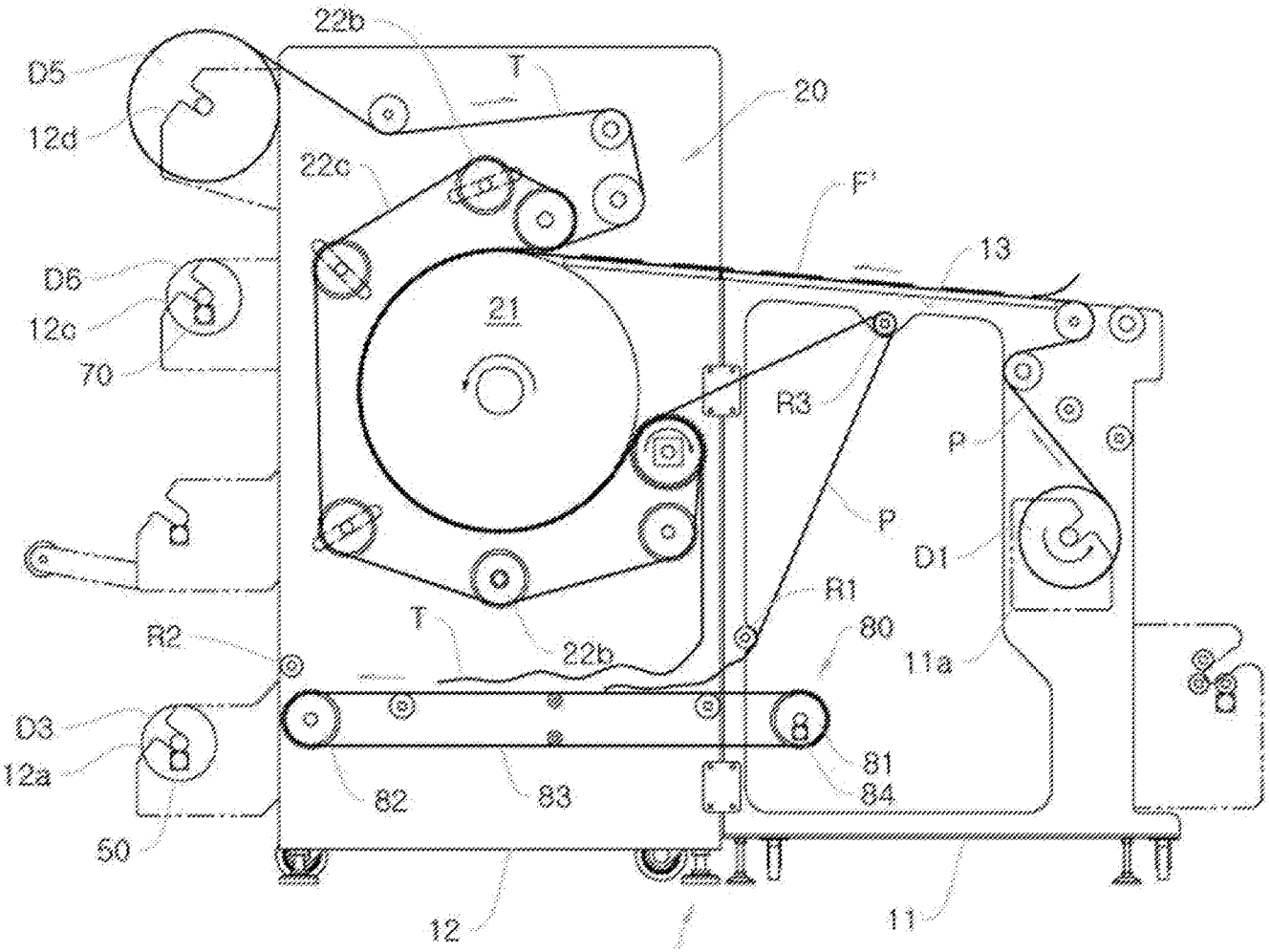
FIG. 5B is a view illustrating the preparation process of FIG. 5A.

FIG. 5A is a front view showing a hybrid transfer machine according to a second piece-type embodiment the present invention, and FIG. 5B is a view illustrating the preparation process of FIG. 5A.

The overall configuration of the second pieces-type embodiment is the same as that of the first piece-type embodiment only except that a third roller R3 is further included in the second piece-type embodiment.

The third roller R3 is rotatably installed in a first body 11 to be adjacent to a worktable 13, and functions to guide transfer paper P, exiting from a thermal transfer unit 20, to a first roller R1.

As an example, the transfer paper P, a piece of fabric F', and tissue T (which may be omitted as desired) are discharged from the thermal transfer unit 20 in a superimposed state.

Meanwhile, when they are moved in the superimposed state for a long period of time, the transfer paper P and the piece of fabric F' are shaken due to vibrations during movement according to the type of transfer paper P, and thus there may occur a defect in which a transferred portion is smudged or migrated. Furthermore, there may occur a problem in which the transfer paper P and fabric F' superimposed on each other are adhered to each other and are not easily separated from each other.

Accordingly, as shown in FIG. 5B, when only the transfer paper P is loaded to be passed over the first roller R1 via the third roller R3, the transfer paper P and the piece of fabric F' are naturally separated from each other when the transfer paper P, the piece of fabric F', and the tissue T (which may be omitted as desired) are discharged from the thermal transfer unit 20, thereby overcoming the problem in which a defect occurs in a product.

Furthermore, the transfer paper P is wound around a transfer paper take-up drum D3 via the first roller R1. In this case, the piece of fabric F' discharged from a thermal transfer unit 20 falls down onto the transfer paper P, and is transferred by the transfer paper P. The transferred piece of fabric F' is naturally separated at an end of the transfer paper take-up drum D3, falls downward, and is then collected.

Third Embodiment

Figure 6A:
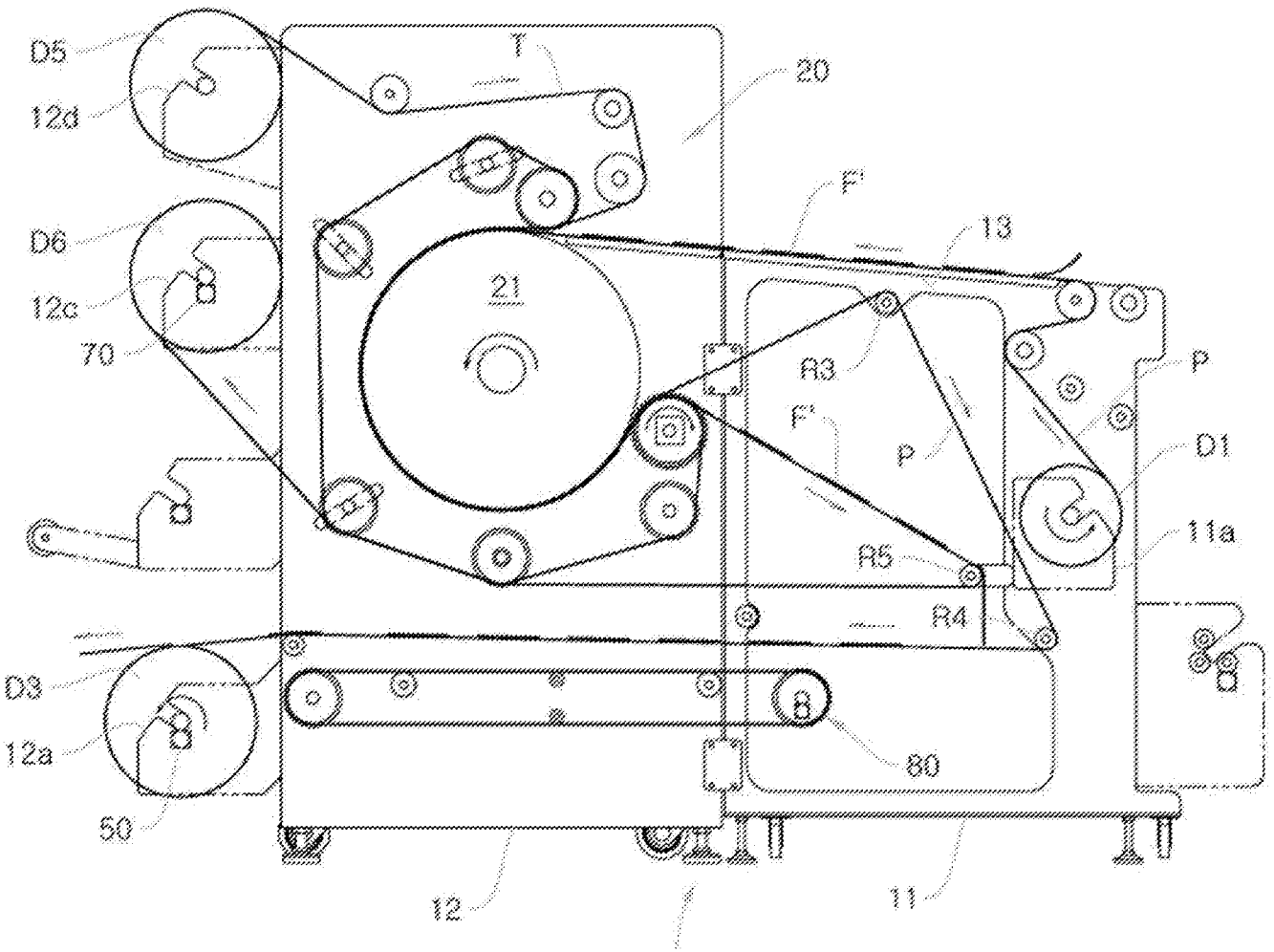
FIG. 6A is a front view showing a hybrid transfer machine according to a third piece-type embodiment of the present invention.
Figure 6B:
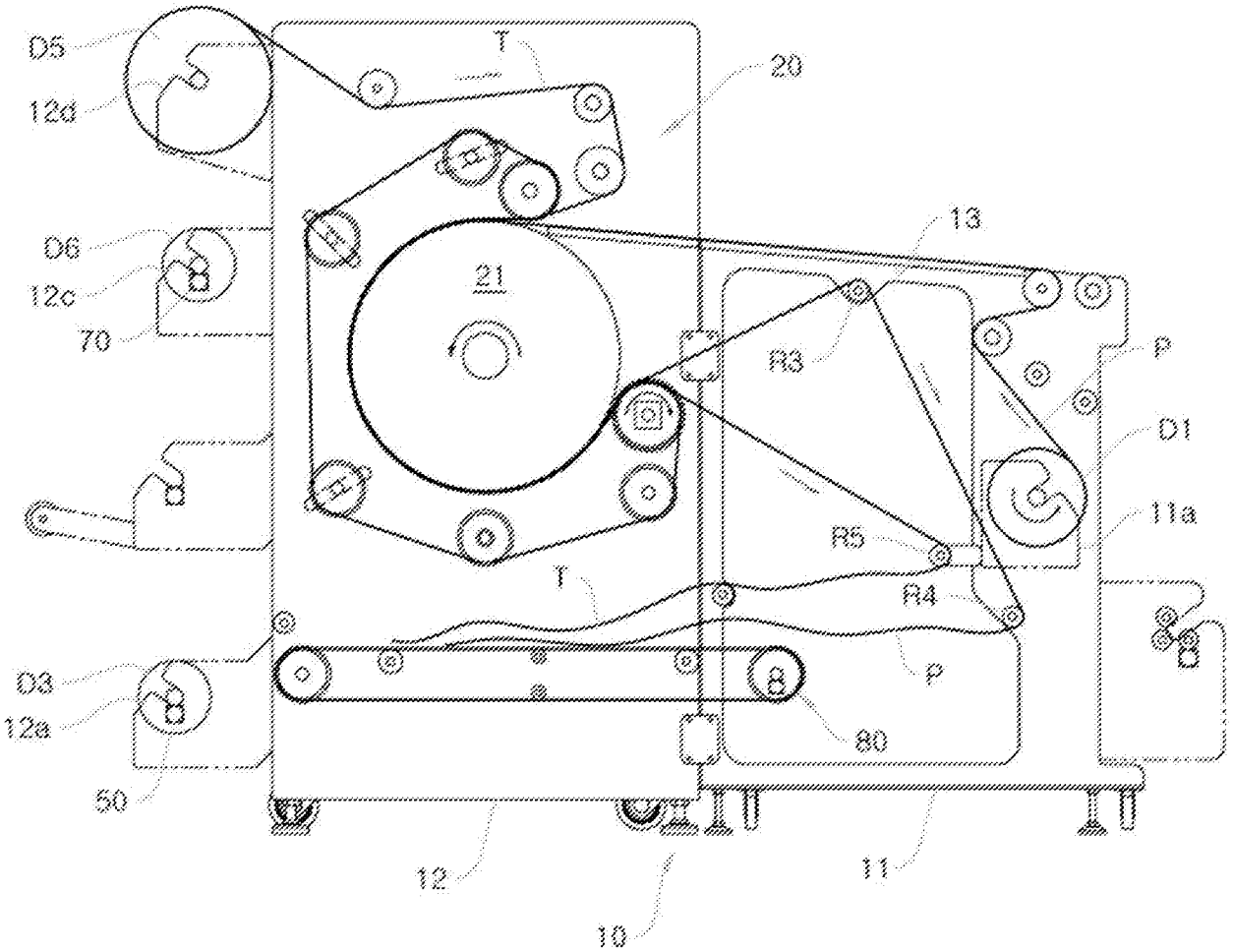
FIG. 6B is a view illustrating a preparation process of FIG. 6A.

FIG. 6A is a front view showing a hybrid transfer machine according to a third piece-type embodiment of the present invention, and FIG. 6B is a view illustrating a preparation process of FIG. 6A.

The overall configuration of the third embodiment is the same as that of the second embodiment only except that a fourth roller R4 and a fifth roller R5 are further included in the third embodiment.

The fourth roller R4 is rotatably installed between a third roller R3 and a conveyer 80 in a first body 11, and functions to guide transfer paper P, guided by the third roller R3, to a transfer paper take-up drum D3.

The fifth roller R5 is rotatably installed between the third roller R3 and the fourth roller R4 inside the first body 11, and functions to guide tissue T, exiting from a thermal transfer unit 20, to a tissue take-up drum D6.

As an example, the transfer paper P, a piece of fabric F', and tissue T are discharged from the thermal transfer unit 20 in a superimposed state.

Meanwhile, when they are moved in the superimposed state for a long period of time, the transfer paper P and the piece of fabric F' are shaken due to vibrations during movement according to the type of transfer paper P, and thus there may occur a defect in which a transferred portion is smudged or migrated. Furthermore, there may occur a problem in which the transfer paper P and fabric F' superimposed on each other are adhered to each other and not easily separated from each other.

Accordingly, as shown in FIG. 6B, when only the transfer paper P is loaded to be passed over the first roller R1 via the third roller R3, the transfer paper P and the fabric F' are naturally separated from each other when the transfer paper P, the fabric F', and the tissue T (which may be omitted as desired) are discharged from the thermal transfer unit 20, thereby overcoming the problem in which a defect occurs in a product.

Accordingly, as shown in FIG. 6B, when the transfer paper P discharged from the thermal transfer unit 20 is loaded to be passed over the fourth roller R4 via the third roller R3 and the tissue T discharged from the thermal transfer unit 20 is loaded to be passed over the fifth roller R5, the transfer paper P and the piece of fabric F' are naturally separated from each other when the transfer paper P, the piece of fabric F', and the tissue T (which may be omitted as desired) are discharged from the thermal transfer unit 20, thereby overcoming the problem in which a defect occurs in a product.

Furthermore, the transfer paper P is wound around the transfer paper take-up drum D3 via the third roller R3 and the fourth roller R4. In this case, the piece of fabric F' is placed on the tissue T wound around the tissue take-up drum D6 via the fifth roller R5, and is transferred along with the tissue T. During the transfer, the piece of fabric F' falls downward from the fifth roller R5, and is placed on the transfer paper P. The piece of fabric F' is transferred in the state of being placed on the transfer paper P, and the transferred piece of fabric F' naturally falls downward from an end of the transfer paper take-up drum D3 and is then collected.

For reference, the tissue T is disposed between the fabric F or piece of fabric F' and the first belt 22*c* of the thermal transfer unit 20, and prevents the belt 22*c* from being contaminated or a print object from being migrated to the belt 22*c*. In the present embodiment, the tissue T performs not only the above function but also the function of transferring the piece of fabric F' to the transfer paper P.

According to the present invention, an operator can enter via the entrance formed through the body and perform an operation during an initial setting operation, and transfer paper, fabric, and tissue can be easily transferred via the conveyer installed inside the body. Accordingly, the initial setting operation of connecting transfer paper, fabric and, tissue can be further conveniently and easily performed, with the result that the convenience of operation can be improved and setting time can be reduced, thereby providing an advantage in that operability is further improved.

While the present invention has been described in detail with reference to the specific embodiments, it will be apparent to those skilled in the art that various modifications and alterations can be made within the technical spirit of the present invention and fall within the attached claims.

What is claimed is:

1. A hybrid transfer machine, comprising:

a body comprising a first drum installation part configured such that a transfer paper feed drum is rotatably installed therein, a second drum installation part configured such that a fabric feed drum is rotatably installed therein, a first body configured such that an entrance is formed therethrough so that an operator enters thereinto and performs an operation, a second body configured to be disposed adjacent to the first body and configured such that a third drum installation part and a fourth drum installation part are sequentially formed from a lower portion of one side of an outside thereof, and a worktable configured to be installed on a top surface of the first body and to couple the first body with the second body;

a first drive means configured to allow wound fabric to be unwound by rotating the fabric feed drum;

a thermal transfer unit configured to be installed in the second body, and to press and heat the fabric and transfer paper fed from the worktable so that a print object of the transfer paper is transferred onto the fabric, the thermal transfer unit comprising a first belt and a plurality of pulleys supporting the belt, including a first drive pulley located horizontally closer to the first body than any of the other pulleys;

a second drive means configured to allow the transfer paper to be wound by rotating a transfer paper take-up drum which is rotatably installed in the third drum installation part;

a third drive means configured to allow the fabric, onto which the print object has been transferred, to be wound by rotating a fabric take-up drum which is rotatably installed in the fourth drum installation part;

a conveyer configured to be installed in the body, and to transfer the fabric and the transfer paper, passed through the thermal transfer unit, to the third and fourth drum installation parts;

a first roller configured to be rotatably installed in the first body to be disposed below and horizontally closer to the first body than the first drive pulley in a direction in which the transfer paper heated by a heating drum of the thermal transfer unit is discharged, and to guide the transfer paper, exiting from the thermal transfer unit, to the transfer paper take-up drum; and a transfer paper guide unit including a crank configured to be disposed above the first drive pulley and adjacent to the heating drum, to be rotatably installed in the second body via a shaft, to be rotatably provided with a roller configured to guide the transfer paper at an upper end thereof, and to rapidly separate the transfer paper exiting from the thermal transfer unit and guide the separated transfer paper to the first roller and an actuator configured to be installed in the second body and to rotate the crank around the shaft so that the roller becomes disposed adjacent to or spaced apart from the heating drum.

2. The hybrid transfer machine of claim 1, further comprising:

a fifth drum installation part configured such that a tissue take-up drum is rotatably installed therein, and a sixth drum installation part configured such that a tissue feed drum is rotatably installed therein, the fifth drum installation part and the sixth drum installation part being sequentially installed in an upper portion of the fourth drum installation part of the second body; and a fourth drive means configured to allow the tissue to be wound by rotating a tissue take-up drum which is rotatably installed in the fifth drum installation part.

3. A hybrid transfer machine, comprising:

a body comprising a first drum installation part configured such that a transfer paper feed drum is rotatably installed therein, a second drum installation part configured such that a fabric feed drum is rotatably installed therein, a first body configured such that an entrance is formed therethrough so that an operator enters thereinto and performs an operation, a second body configured to be disposed adjacent to the first body and configured such that a third drum installation part and a fourth drum installation part are sequentially formed from a lower portion of one side of an outside thereof, and a worktable configured to be installed on a top surface of the first body and to couple the first body with the second body;

a first drive means configured to allow wound fabric to be unwound by rotating the fabric feed drum;

a thermal transfer unit configured to be installed in the second body, and to press and heat the fabric and transfer paper fed from the worktable so that a print object of the transfer paper is transferred onto the fabric, the thermal transfer unit comprising a first belt and a plurality of pulleys supporting the belt, including a first drive pulley located horizontally closer to the first body than any of the other pulleys;

a second drive means configured to allow the transfer paper to be wound by rotating a transfer paper take-up drum which is rotatably installed in the third drum installation part;

a third drive means configured to allow the fabric, onto which the print object has been transferred, to be wound by rotating a fabric take-up drum which is rotatably installed in the fourth drum installation part;

a conveyer configured to be installed in the body, and to transfer the fabric and the transfer paper, passed through the thermal transfer unit, to the third and fourth drum installation parts;

a first roller configured to be rotatably installed in the first body to be disposed below and horizontally closer to the first body than the first drive pulley in a direction in which the transfer paper heated by a heating drum of the thermal transfer unit is discharged, and to guide the transfer paper, exiting from the thermal transfer unit, to the transfer paper take-up drum so that each piece of fabric exiting from the thermal transfer unit is transferred by the transfer paper; and a third roller configured to be rotatably installed in the first body to be disposed vertically between the worktable and the first drive pulley and horizontally farther away from the second body than the first roller and to rapidly separate the transfer paper exiting from the thermal transfer unit and guide the separated transfer paper to the first roller.

4. A hybrid transfer machine, comprising:

a body comprising a first drum installation part configured such that a transfer paper feed drum is rotatably installed therein, a second drum installation part configured such that a fabric feed drum is rotatably installed therein, a first body configured such that an entrance is formed therethrough so that an operator enters thereinto and performs an operation, a second body configured to be disposed adjacent to the first body and configured such that a third drum installation part and a fourth drum installation part are sequentially formed from a lower portion of one side of an outside thereof, and a worktable configured to be installed on a top surface of the first body and to couple the first body with the second body;

a first drive means configured to allow wound fabric to be unwound by rotating the fabric feed drum;

a thermal transfer unit configured to be installed in the second body, and to press and heat the fabric and transfer paper fed from the worktable so that a print object of the transfer paper is transferred onto the fabric, the thermal transfer unit comprising a first belt and a plurality of pulleys supporting the belt, including a first drive pulley located horizontally closer to the first body than any of the other pulleys;

a second drive means configured to allow the transfer paper to be wound by rotating a transfer paper take-up drum which is rotatably installed in the third drum installation part;

a third drive means configured to allow the fabric, onto which the print object has been transferred, to be wound by rotating a fabric take-up drum which is rotatably installed in the fourth drum installation part;

a conveyer configured to be installed in the body, and to transfer the fabric and the transfer paper, passed through the thermal transfer unit, to the third and fourth drum installation parts;

a fifth drum installation part configured such that a tissue take-up drum is rotatably installed therein, and a sixth drum installation part configured such that a tissue feed drum is rotatably installed therein, the fifth drum installation part and the sixth drum installation part being sequentially installed in an upper portion of the fourth drum installation part of the second body;

a fourth drive means configured to allow the tissue to be wound by rotating a tissue take-up drum which is rotatably installed in the fifth drum installation part;

a third roller configured to be rotatably installed in the first body to be disposed vertically between the worktable and the first drive pulley and horizontally away from the first drive pulley in a direction in which the transfer paper heated by a heating drum of the thermal transfer unit is discharged, and to rapidly separate and guide the transfer paper exiting from the thermal transfer unit;

a fourth roller configured to be rotatably installed in the first body to be disposed horizontally farther away from the second body than the third roller and lower than the first drive pulley and to guide the transfer paper, guided by the third roller, to the transfer paper take-up drum so that each piece of fabric exiting from the thermal transfer unit is transferred by the transfer paper; and a fifth roller configured to be rotatably installed in the first body to be disposed horizontally between the third roller and the fourth roller and vertically below the first drive pulley and above the fourth roller and to guide the tissue, exiting from the thermal transfer unit along with each piece of fabric, to the tissue take-up drum.

* * * * *